US008294057B2

(12) United States Patent
Yamazaki et al.

(10) Patent No.: US 8,294,057 B2
(45) Date of Patent: Oct. 23, 2012

(54) ELECTRODE FOR SWITCH AND VACUUM SWITCH, AND METHOD OF MANUFACTURING ELECTRODE FOR SWITCH OR VACUUM SWITCH

(75) Inventors: Miki Yamazaki, Kashiwa (JP); Kenji Tsuchiya, Hitachi (JP); Ayumu Morita, Hitachi (JP); Masato Kobayashi, Hitachi (JP); Shuichi Kikukawa, Hitachi (JP); Shigeru Kikuchi, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 100 days.

(21) Appl. No.: 12/857,253

(22) Filed: Aug. 16, 2010

(65) Prior Publication Data

US 2011/0073567 A1 Mar. 31, 2011

(30) Foreign Application Priority Data

Sep. 30, 2009 (JP) ..... 2009-225880
May 20, 2010 (JP) ..... 2010-115888

(51) Int. Cl.
*H01H 33/666* (2006.01)

(52) U.S. Cl. ..... 218/140; 200/279; 218/68; 218/123

(58) Field of Classification Search ..... 218/68, 218/123–129, 140; 200/279
See application file for complete search history.

(56) References Cited

U.S. PATENT DOCUMENTS 2,234,346 A 3/1941 Ives
3,852,555 A * 12/1974 Schuocker et al. ..... 218/127
4,117,288 A * 9/1978 Gorman et al. ..... 218/129
4,260,864 A * 4/1981 Wayland et al. ..... 218/129
4,530,815 A 7/1985 Inagaki
4,926,017 A * 5/1990 Aoki et al. ..... 218/123
5,420,384 A * 5/1995 Okutomi et al. ..... 218/68
5,557,083 A * 9/1996 Komuro et al. ..... 218/123
5,646,386 A * 7/1997 Yorita et al. ..... 218/129
6,437,275 B1 * 8/2002 Kikuchi et al. ..... 218/123
6,649,855 B2 * 11/2003 Nishijima et al. ..... 218/128

FOREIGN PATENT DOCUMENTS

JP 1-105428 A 4/1989
JP 5-47274 A 2/1993
JP 5-298971 A 11/1993
JP 8-273500 A 10/1996

OTHER PUBLICATIONS

Corresponding European Search Report dated Dec. 28, 2010 (Five (5) pages).

* cited by examiner

*Primary Examiner* — Truc Nguyen
(74) *Attorney, Agent, or Firm* — Crowell & Moring LLP

(57) ABSTRACT

An object of the invention is to provide a vacuum switch which can achieve a reduction of an electric loss and an improvement of a heat transmission performance by preventing an air gap portion from being generated between an electrode and a conductor rod and preventing the electrode and the conductor rod from generating any positional displacement. An electrode for a switch in accordance with the invention is provided with the conductor rod, a contact point electrode inserted to the conductor rod, and a coupling plate fixing both the elements to an outer side in a diametrical direction of the conductor rod and the contact point electrode, thereby fixing both the elements.

12 Claims, 10 Drawing Sheets

CROSS SECTIONAL VIEW ALONG LINE C-C'

CROSS SECTIONAL VIEW ALONG LINE B-B

ELECTRODE FOR SWITCH AND VACUUM SWITCH, AND METHOD OF MANUFACTURING ELECTRODE FOR SWITCH OR VACUUM SWITCH

BACKGROUND OF THE INVENTION (1) Field of the Invention

The present invention relates to an electrode for a switch and a vacuum switch, and a method of manufacturing the electrode for the switch or the vacuum switch.

(2) Description of Related Art

Since the vacuum switch employs a vacuum insulation having a high insulation performance, and does not use a gas such as $SF_6$ or the like having a high global warming coefficient, it is a switch which can achieve both downsizing and reduction of an environmental load.

The vacuum switch carries out an electric current break or the like in an inner portion of a vacuum vessel, however, a method of manufacturing the vacuum vessel in a high vacuum exists as a method of manufacturing the vacuum vessel. In this case, in a brazing in a manufacturing step of the vacuum vessel, it is necessary to properly use a brazing filler metal in correspondence to a material between members constructing the vacuum vessel. Accordingly, it is necessary to separate the brazing into at least two steps.

A first step is a step of connecting metals to each other such as a connection between an electrode and a conducting bar, and a second step is a step of including the members adhered in accordance with the first step in an inner portion, connecting an insulation tube and a metal end plate, and constructing a vacuum sealed vacuum vessel. The first step is structured such as to connect the metals to each other, however, the second step has to connect the insulation material and the metal. Accordingly, it is necessary to use different brazing filler materials, respectively.

Therefore, there is a possibility that the brazing filler material used in the first step is again molten in the second step, and if the brazing filler material is molten in the second step, the brazing filler material used for connecting the electrode and the conducting rod in the first step is deformed, so that there is a possibility that an air gap is generated between the electrode and the conductor rod, and a displacement is generated between the electrode and the conducting rod.

In order to prevent the displacement between the electrode and the conducting rod as mentioned above from being generated, for example, there is a structure described in patent document 1 (JP-A-5-298971). The patent document 1 has a description of an electrode which has an electrode rod provided with protruding portions 6*a* and 7*a* in an end portion, and an insertion hole having the same shape as the end portion of the electrode rod, and in which grooves 4*a* and 5*b* are formed in an inner portion, and describes an assembling method of the electrode rod and the electrode for finishing an assembly by setting a brazing filler material to a joint position between the electrode rod and the electrode, inserting the electrode rod to an electrode rod insertion port of the electrode, and rotating at about 90 degree in such a manner as to guide the protruding portions 6*a* and 7*a* of the end portion of the electrode rod to a groove in an inner portion of the electrode and locking, as an assembling method of the electrode rod and the electrode (paragraph [0008] to [0009] of the specification of the patent document 1.) Further, there is described that an object of the invention is to provide a vacuum valve which can prevent the electrode from coming off and being inclined and prevent a positional displacement between the electrode rod and the electrode in a final assembling step, and has a high reliability without lowering a performance serving as the vacuum valve, in the case that a brazing temperature in a partial assembling step is the same as a brazing temperature at which a vacuum sealing is carried out in a final assembling step (paragraph [0005] of the specification of the patent document 1).

In this case, in the case that an air gap is generated between the electrode and the conducting rod, the air gap portion is occupied with an insulation medium such as a vacuum or the like. Since this portion exhibits a high insulating property, this portion comes to a high resistance portion at a time of conducting an electric current, and a conducting property of the electric current is lowered. Further, since a coefficient of thermal conductivity is lower in the air gap portion (for example, filled with a vapor or a gas in the case of an air brake insulation switch, filled with a gas in the case of a gas insulation switch, and filled with a vacuum in the case of a vacuum insulation switch, respectively) in comparison with the electrode corresponding to the metal material, and a heat conduction is prevented in the air gap portion, the electrode coming to a high temperature at a time when the electric current is broken is hard to be radiated heat, and a possibility that the electrode member is molten becomes higher. There is a risk that they cause a reduction of a reliability.

In the patent document 1 mentioned above, the protruding portion of the end portion of the electrode rod is rotated and locked in such a manner as to be guided to the groove in the inner portion of the electrode, however, on the assumption that the assembling method mentioned above is achieved, it is necessary that a clearance gap is provided to some extent between the protruding portion of the end portion of the electrode rod and the groove in the inner portion of the electrode. In the case that no clearance gap is provided, the protruding portion of the end portion of the electrode rod can not be rotated with respect to the groove in the inner portion of the electrode. Further, the clearance gap corresponds to the air gap portion mentioned above eventually. Accordingly, in the case of intending to fix the electrode rod and the electrode on the basis of a rotation, it is unavoidable that an air gap portion exists to some extent or is enlarged.

BRIEF SUMMARY OF THE INVENTION

Accordingly, an object of the present invention is to provide an electrode or a switch which can improve a reliability of the switch, or a method of manufacturing the electrode for the switch or a vacuum switch.

In order to achieve the object mentioned above, in accordance with the present invention, there is provided an electrode for a switch including a conductor rod, a contact point electrode inserted to the conductor rod, and a coupling plate fixing both the elements to an outer side in a diametrical direction of the conductor rod and the contact point electrode.

In the electrode for the switch in accordance with the present invention, it is preferable that the conductor rod is provided with a groove in a diametrical direction in an outer peripheral portion, the contact point electrode is provided with a groove in a diametrical direction in an outer peripheral portion, and the coupling plate is fitted to the groove in the diametrical direction which the conductor rod has its outer peripheral portion, and the groove in the diametrical direction which the contact point electrode has its outer peripheral portion, and fixes the conductor rod and the contact point electrode.

Further, in the electrode for the switch in accordance with the present invention, it is preferable that the coupling plate is provided with a groove in a diametrical direction in an outer peripheral portion, the contact point electrode is provided with a groove positioned in the same circumference as the groove which the coupling plate is provided in the diametrical direction in its outer peripheral portion, at a position except the outer peripheral portion to which the coupling plate is fitted, in the outer peripheral portion, and the coupling plate is provided with a fixing member fitted to the groove in the diametrical direction which the coupling plate is provided in its outer peripheral portion, and the groove which the contact point electrode is provided in its outer peripheral portion, the groove being positioned in the same circumference as the groove which the coupling plate is provided in the diametrical direction in its outer peripheral portion.

Further, in the electrode for the switch in accordance with the present invention, it is preferable that the coupling plate is provided with a flexibility.

Further, in the electrode for the switch in accordance with the present invention, it is preferable that the coupling plate and/or the fixing member is constructed by a plurality of members.

Further, in the electrode for the switch in accordance with the present invention, it is preferable that the contact point electrode is provided with a spiral groove at a position except a portion lapping over the conductor rod, in an axial direction of the conductor rod.

Further, in accordance with the present invention, there is provided a vacuum switch including the electrode for the switch in accordance with the present invention, and an insulation tube and an end plate constructing a vacuum vessel in which an inner portion comes to vacuum, wherein the insulation tube and the end plate are brazed therebetween, and the electrode for the switch is stored in the inner portion of the vacuum vessel.

In accordance with the present invention, there is provided a vacuum switch including a conductor rod having a groove in a diametrical direction in a part in an axial direction, a contact point electrode provided with an insertion hole to which the conductor rod is inserted, structured such that the conductor rod is inserted to the insertion hole, and having a groove in a diametrical direction in an outer peripheral portion, a coupling plate fitted to the groove in the diametrical direction which the conductor rod has, and the groove in the diametrical direction of the outer peripheral portion which the contact point electrode has, and fixing the conductor rod and the contact point electrode, and a vacuum vessel constructed by an insulation tube and a metallic end plate, connoting the conductor rod and the contact point electrode, and coming to vacuum in its inner portion, wherein a first brazing filler material is provided in a contact surface between the conductor rod and the contact point electrode, and a second brazing filler material is provided between the insulation tube and the metallic end plate.

Further, in accordance with the present invention, there is provided a vacuum switch including a conductor rod having a groove in a diametrical direction in a part in an axial direction, a contact point electrode provided with an insertion hole of the conductor rod, structured such that the conductor rod is inserted to the insertion hole, provided with concave portions at two positions or more in an outer peripheral portion, and structured such that a portion except the concave portions in the outer peripheral portion has a groove in a diametrical direction, a coupling plate fitted to the groove which the conductor rod has, and the concave portions which the contact point electrode has, and provided with a groove constructing the same circumference as the groove which the contact point electrode has in the portion except the concave portions in the outer peripheral portion, in the portion fitted to the concave portions which the contact point electrode has, a ring pin fitted to the groove which the contact point electrode has in its outer peripheral portion and the groove which the coupling plate is provided, and fixing the contact point electrode and the coupling plate, and a vacuum vessel constructed by an insulation tube and a metallic end plate, connoting the conductor rod and the contact point electrode, and coming to vacuum in its inner portion, wherein a first brazing filler material is provided in a contact surface between the conductor rod and the contact point electrode, and a second brazing filler material is provided between the insulation tube and the metallic end plate.

In the vacuum switch in accordance with the present invention, it is preferable that the coupling plate is provided with a flexibility.

Further, in the vacuum switch in accordance with the present invention, it is preferable that the coupling plate is separated into two or more sections.

Further, in the vacuum switch in accordance with the present invention, it is preferable that the contact point electrode is provided with spiral grooves at two positions or more in a portion except a portion lapping over the conductor rod, in an axial direction of the conductor rod.

Further, in accordance with the present invention, there is provided a vacuum switch including the vacuum switch in accordance with the present invention, a cable feeding an electric power to a load side, a bus bar feeding an electric power to the vacuum switch, and an operation device opening and closing the vacuum switch.

Further, in order to achieve the object mentioned above, in accordance with the present invention, there is provided a method of manufacturing an electrode for a switch, including a step of inserting a conductor rod to an electrode having an insertion hole, and thereafter fitting a coupling plate to an outer side in a diametrical direction of the conductor rod and the contact point electrode.

In the method of manufacturing the electrode for the switch in accordance with the present invention, it is preferable that a groove in a diametrical direction is formed in an outer peripheral portion in the coupling plate, and a groove positioned in the same circumferential shape as the groove which the coupling plate is provided in the diametrical direction in its outer peripheral portion, is formed at a position except the outer peripheral portion to which the coupling plate is fitted, in the outer peripheral portion, in the contact point electrode, and the method has a step of fitting the coupling plate to an outer side in the diametrical direction of the conductor rod and the contact point electrode, and thereafter fitting a fixing member to the groove formed in the coupling plate and the groove formed in the contact point electrode, thereby fixing the coupling plate, the conductor rod and the contact point electrode.

In accordance with the present invention, there is provided a method of manufacturing a vacuum switch including a step of brazing an insulation tube and an end plate under a vacuum or a hydrogen gas, while connoting the electrode for the switch, after the step mentioned above.

In the method of manufacturing the vacuum switch in accordance with the present invention, it is preferable that the brazing step is constructed by only one brazing step under the vacuum or the hydrogen gas.

EFFECT OF THE INVENTION

In accordance with the present invention, it is possible to provide the electrode or the switch which can improve a reliability of the switch, or the method of manufacturing the electrode for the switch or the vacuum switch.

Other objects, features and advantages of the invention will become apparent from the following description of the embodiments of the invention taken in conjunction with the accompanying drawings.

DESCRIPTION OF REFERENCE NUMERALS

Figure 1:
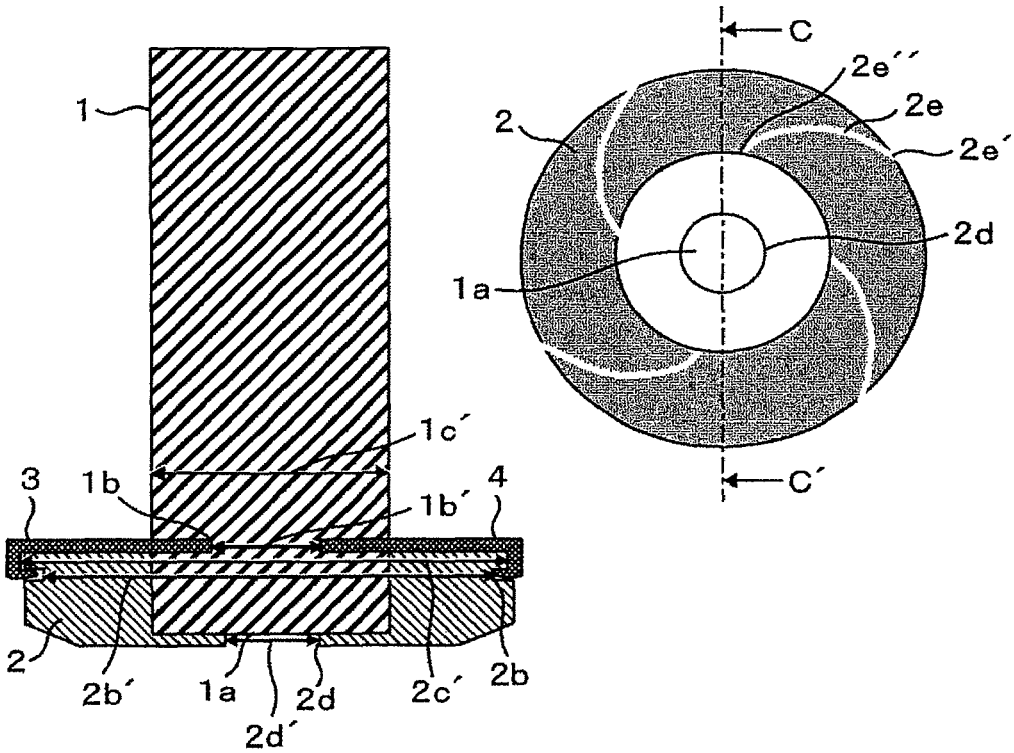
FIG. 1 is a cross sectional view in an axial direction of an electrode portion in accordance with a first embodiment.
Figure 2:
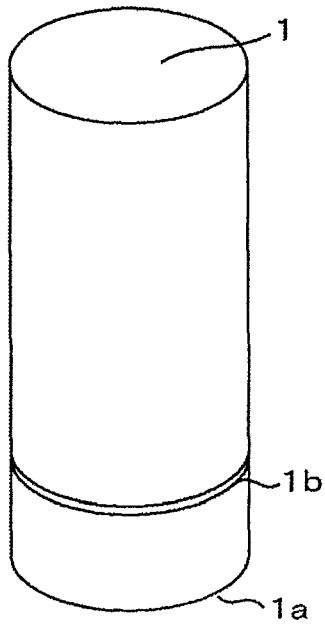
FIG. 2 is a view showing a conductor rod in accordance with the first embodiment.
Figure 3:
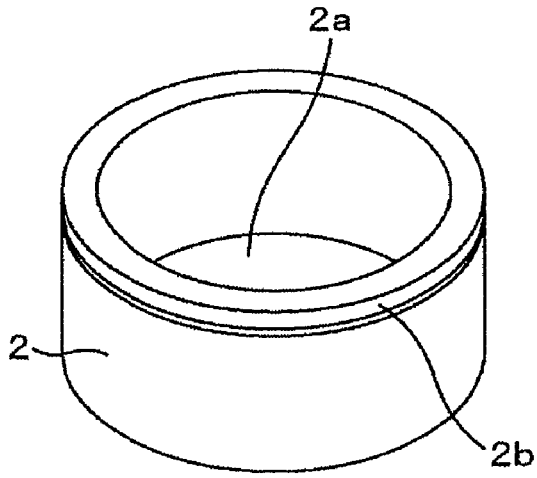
FIG. 3 is a view showing a contact point electrode in accordance with the first embodiment.

1 conductor rod
1*a* leading end of conductor rod 1
1*b* first groove
2 contact point electrode
2*a* bottom portion of contact point electrode 2
2*b* second groove
2*c* outer diameter of contact point electrode
2*d* hole in center portion of contact point electrode
2*e* spiral groove of contact point electrode
2*e*' start point of spiral groove of contact point electrode
2*e*" end point of spiral groove of contact point electrode
3, 4 coupling plate
3*a*, 4*a* inner peripheral end portion of coupling plate
3*b*, 4*b* outer peripheral end portion of coupling plate
5 ring pin
52*b* convex portion
52*c* concave portion
53, 60 groove
70 vacuum switch
71 cable
72 bus bar
73 operation device
74 insulation tube
75 end plate

DETAILED DESCRIPTION OF THE INVENTION

A description will be given below of an embodiment which is preferable for carrying out the present invention.

First Embodiment

Figure 17:
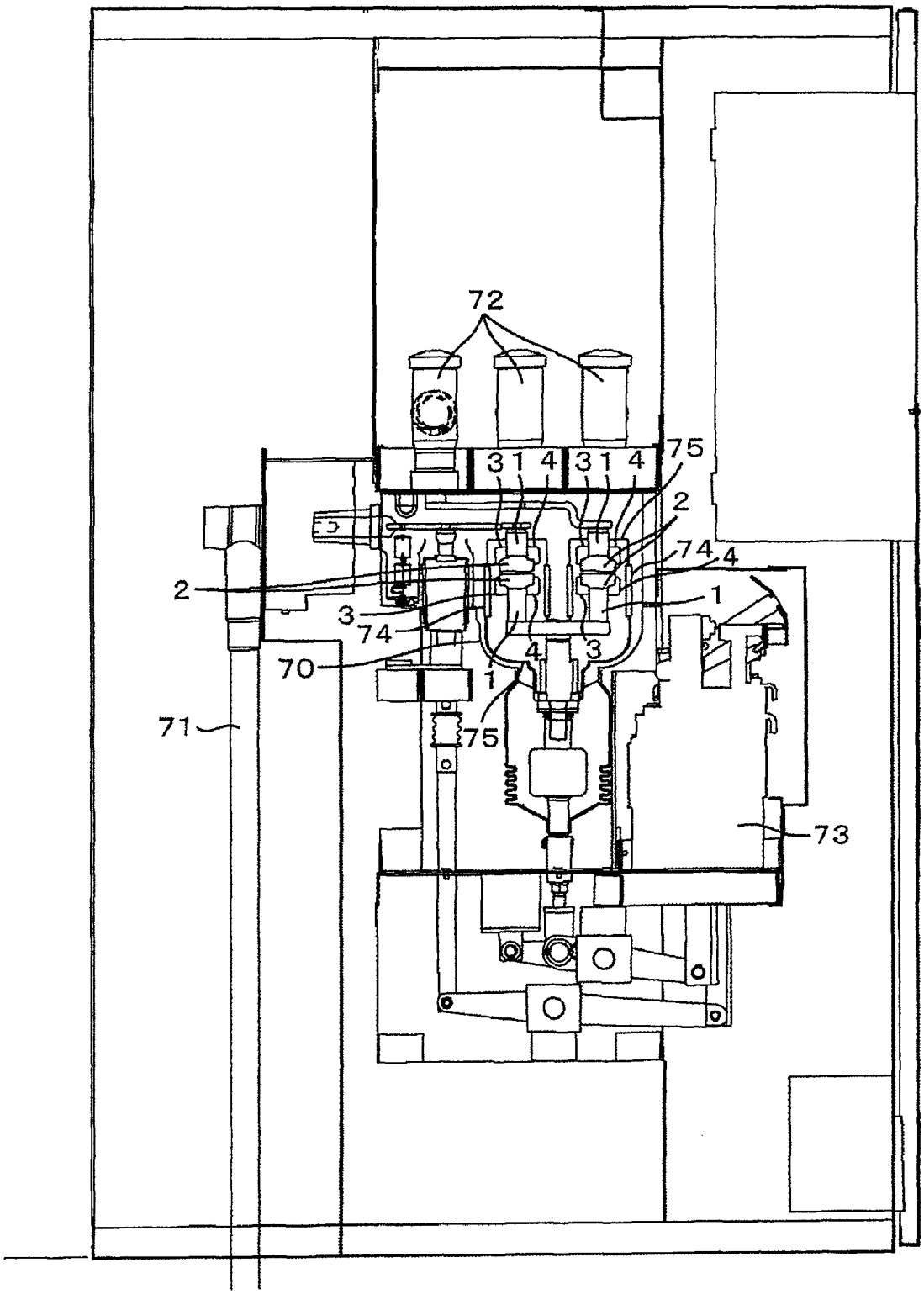
FIG. 17 is a cross sectional view of a vacuum switch gear.
Figure 18:
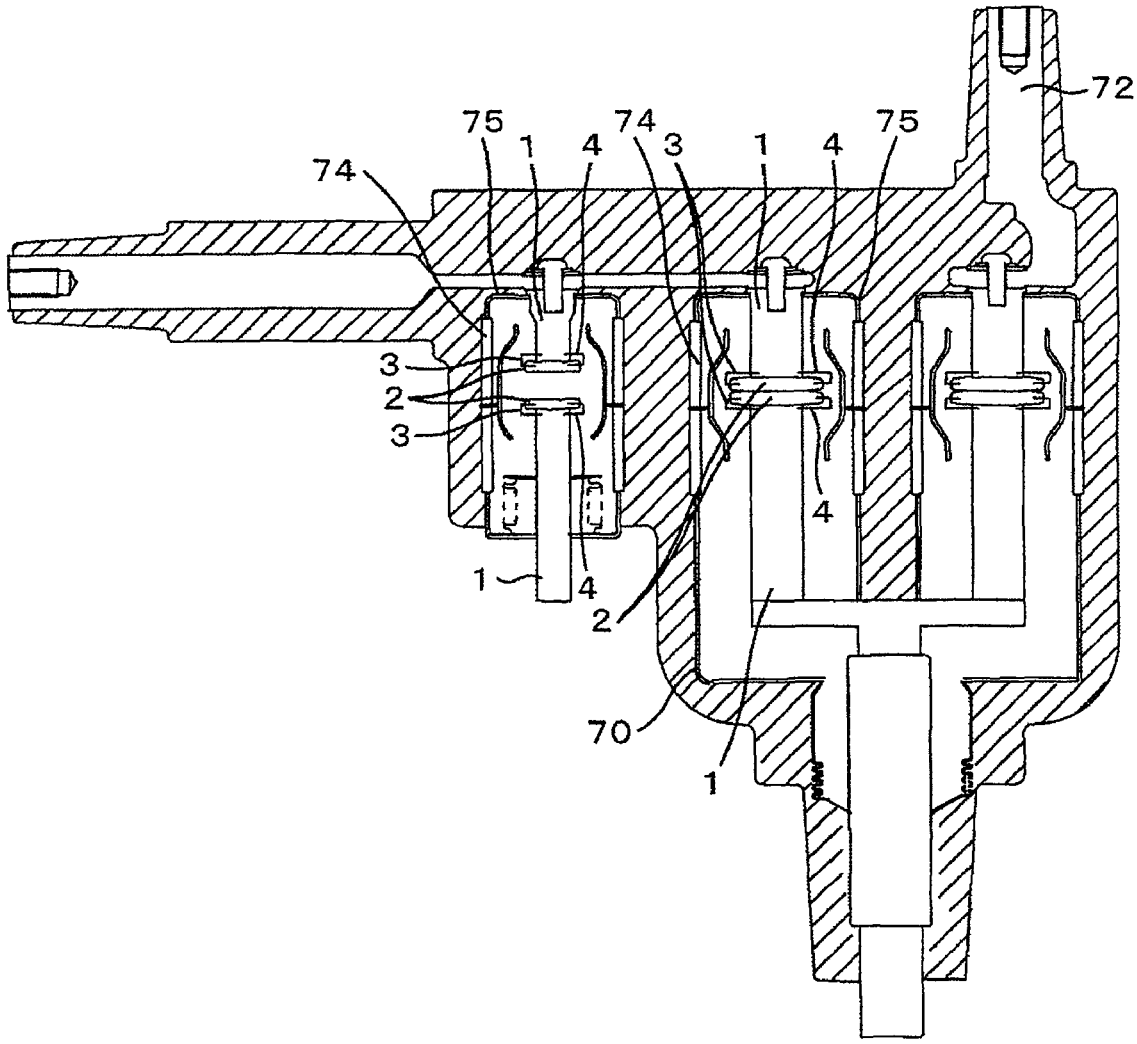
FIG. 18 is an enlarged view of a vacuum switch.

A description will be given of a first embodiment in accordance with the present invention. As shown in FIGS. 17 and 18, a vacuum switch gear in accordance with the present embodiment is mainly constructed by a vacuum switch 70, a cable 71 feeding an electric power to a load side, a bus bar 72 feeding an electric power to a vacuum switch, and an operation device 73 opening, closing and disconnecting the vacuum switch 70. Further, the vacuum switch 70 is constructed by an insulation tube 74 and a metal end plate 75, and is mainly constructed by a vacuum vessel in which an inner portion is set to vacuum, and conductor rods 1 and contact point electrodes 2 in a fixed side and a movable side which are connoted in the vacuum vessel.

Figure 4:
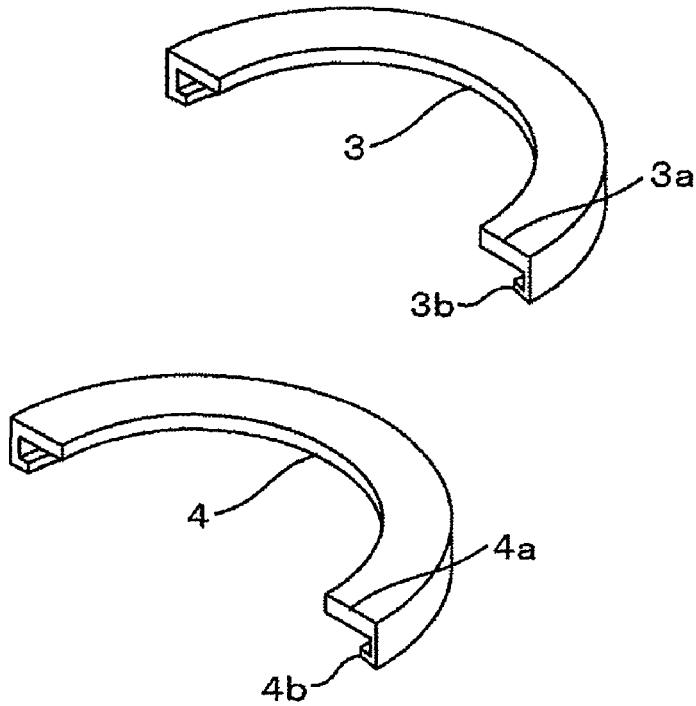
FIG. 4 is a view showing a coupling plate in accordance with the first embodiment.

As shown in FIG. 1, the cylindrical conductor rod 1 constructed by a copper member is inserted to an insertion hole corresponding to a shape of the conductor rod 1 provided in an inner side of the contact point electrode 2, and a first brazing filler material used in a first step is provided between the conductor rod 1 and the contact point electrode 2, whereby the conductor rod 1 and the contact point electrode 2 are fixed with no clearance gap. Further, in the conductor rod 1, there is formed a region (a first groove 1*b*) in which an outer diameter 1*b*' is smaller than an outer diameter 1*c*' of the other region in an axial direction, above the region which is inserted to the contact point electrode 2 of a cylinder shaft. Further, in the contact point electrode 2, there is formed a region (a second groove 2*b*) in which an outer diameter 2*b*' is smaller than an outer diameter 2*c*' of the other region in the axial direction. As shown in FIG. 4, the conductor rod 1 and the contact point electrode 2 are coupled by two coupling plates 3 and 4 which are formed as a semicircular shape by an elastic member, for example, SUS or the like, to the first groove and the second groove. The coupling plates 3 and 4 formed as the semicircular shape at this time are formed as the semicircular shape as shown in FIG. 4 by forming an inner diameter of the coupling plate having a circular shape equal to or larger than an outer diameter 1*b*' of the first groove 1*b* of the conductor rod 1 as shown in a cross sectional view in FIG. 1, forming the outer diameters of the semicircular coupling plates 3 and 4 equal to or larger than an outer diameter 2*c*' of the region except the groove 2*b* of the contact point electrode 2, thereafter dividing the circular coupling plate into two or more in a diametrical direction. Further, these coupling plates 3 and 4 are formed by a material having an excellent elasticity in such a manner as to be freely fitted.

Figure 5:
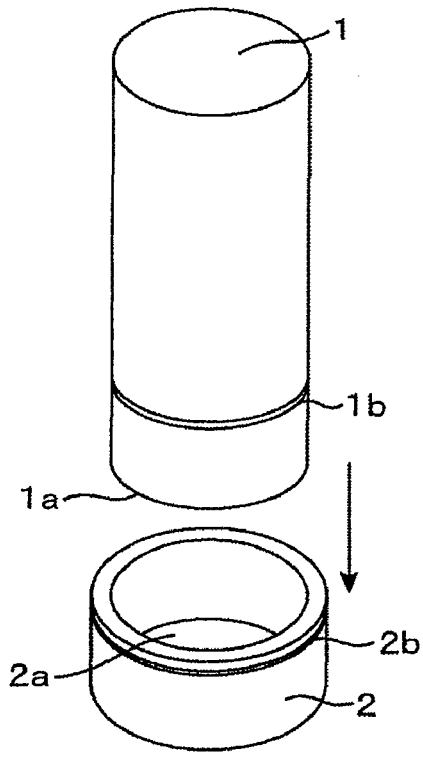
FIG. 5 is a view showing a state in which the conductor rod is inserted to the contact point electrode in accordance with the first embodiment.
Figure 6:
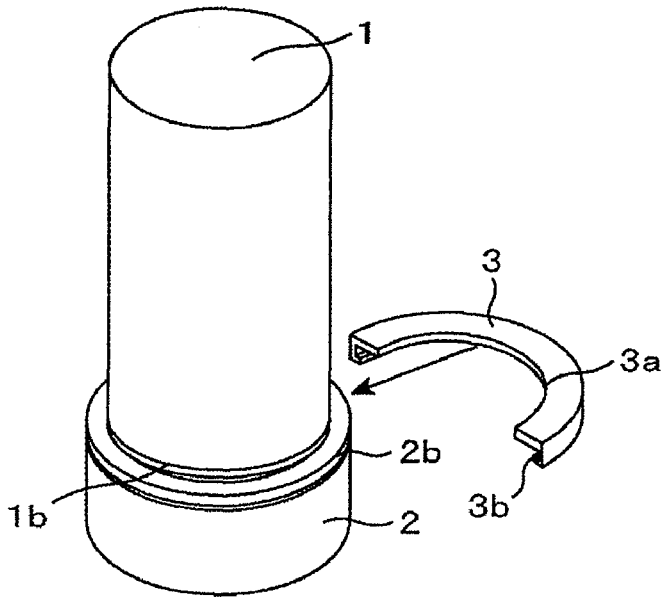
FIG. 6 is a view showing a state in which the coupling plate is fitted to the electrode portion in accordance with the first embodiment.
Figure 7:
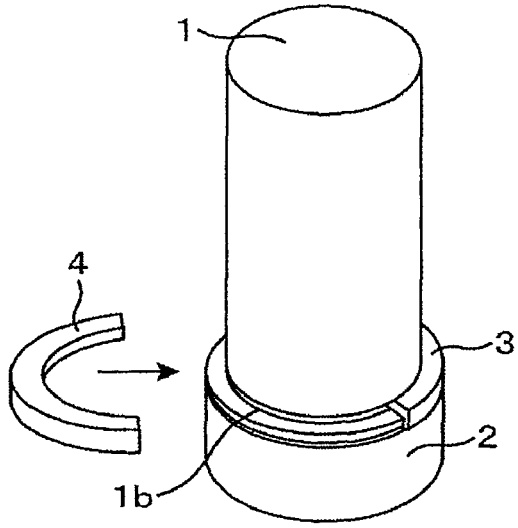
FIG. 7 is a view showing a state in which the coupling plate is fitted to the electrode portion in accordance with the first embodiment.
Figure 8:
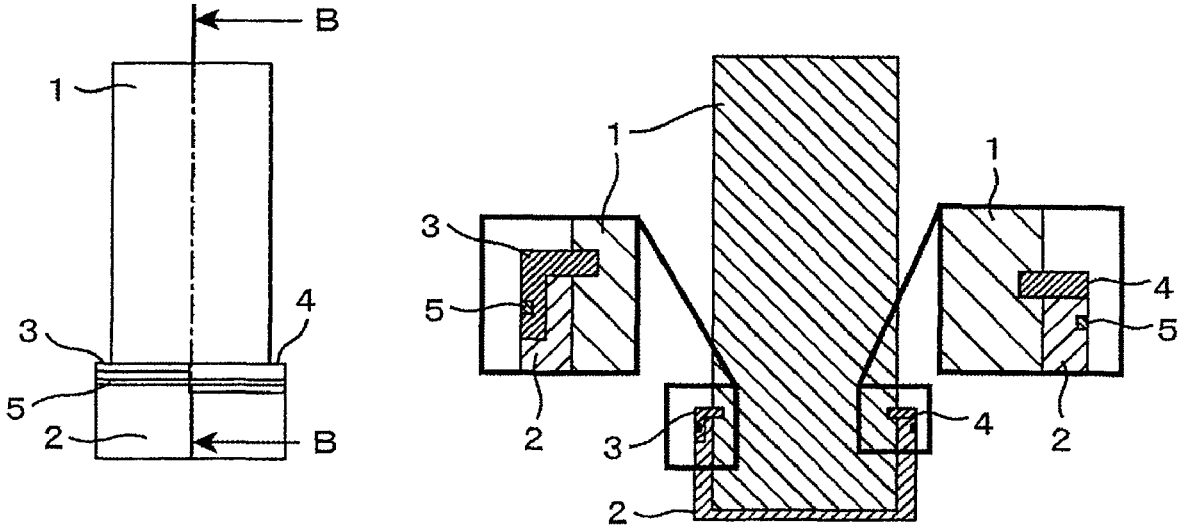
FIG. 8 is a view showing a substantial part of an electrode portion in accordance with a second embodiment.

A description will be given of a method of manufacturing a vacuum switch using the electrode mentioned above with reference to FIGS. 5 to 7. First of all, a first brazing filler material is provided in a contact surface between the conductor rod 1 and the contact point electrode 2, and the conductor rod 1 is inserted to the insertion hole of the contact point electrode 2 as shown in FIG. 5. After the insertion to the insertion hole, inner peripheral end portions 3*a* and 4*a* of the coupling plates 3 and 4 are freely fitted in a radial direction to the first groove 1*b* of the conductor rod 1 as shown in FIGS. 6 and 7, and outer peripheral end portions 3*b* and 4*b* of the coupling plates 3 and 4 are fitted to the second groove 2*b* formed in the contact point electrode 2 so as to fix the conductor rod 1 and the contact point electrode 2. Since the coupling plates 3 and 4 are provided with a flexibility, the fitting is facilitated. Therefore, the conductor rod 1 and the contact point electrode 2 are fixed.

Next, a sealing of the vacuum vessel is completed by brazing the insulation tube 74 and the metal end plate 75 while connoting the conductor rod 1 and the contact point electrode 2 which have been fixed as mentioned above, under a high vacuum or a hydrogen gas. In accordance with this brazing step, the first brazing filler material provided in the contact surface between the conductor rod 1 and the contact point electrode 2 is molten, and is simultaneously brazed. In this case, it is necessary to set a second brazing filler material between the insulation tube 74 and the metal end plate 75, before the present brazing step.

In the present embodiment, since the conductor rod 1 and the contact point electrode 2 are fixed by using the coupling plates 3 and 4, and a rotating motion is not used for fixing, it is possible to fix both the elements without generating any air gap in the center portion of the electrode and the conductor in which an electric current is conducted. In this case, the present embodiment is described as the embodiment about the vacuum switch gear including the electrode and the vacuum switch, as a matter of convenience, however, the invention itself can be realized as the electrode or the vacuum switch independently.

Further, as a very advantageous point in the present embodiment, there can be listed up the matter that the brazing step can be constructed only one step for brazing the insulation tube 74 and the metal end plate 75. This means that it is possible to omit the partially assembling step which has been conventionally carried out, by carrying out the fixing between the conductor rod 1 and the contact point electrode 2 by using the coupling plates 3 and 4. Accordingly, it is possible to achieve a wide improvement of a working efficiency.

Further, since the brazing of the conductor rod 1 and the contact point electrode 2 can be carried out at the same time of the brazing step of the insulation tube 74 and the metal end plate 75, it is possible to prevent the positional displacement between the conductor rod 1 and the contact point electrode 2 which are brazed in the first step from being generated in the second step. The positional displacement of the electrode causes a contact failure between the electrodes. In the case that the contact failure is generated, a non-contact portion between the electrodes comes to a high resistance portion due to a vacuum insulation, whereby an equipment performance of the switch is significantly deteriorated. Further, even if the conduction is generated, it is a contact by an arc so as to cause a melting of the electrode portion, and there is a risk that a reduction of a service life of the equipment is caused. The present embodiment is very useful in a point that the positional displacement of the electrode can be prevented.

Further, in the case that the air gap is generated, a high resistance portion caused by the vacuum insulation is formed within the air gap. Accordingly, the performance as the equipment of the switch is significantly deteriorated. Further, the contact point electrode 2 comes to a high temperature because of generation of an arc at a time of opening and closing, and is demanded to be heat radiated as soon as possible in the light of preventing the electrode from being molten. However, since the air gap is generated within the electrode, and the vacuum portion having a significantly small coefficient of thermal conductivity in comparison with the metal is generated, a heat dissipation performance is lowered, and there is a possibility that the electrode is molten. In the case that the electrode is molten, the electrode surface becomes non-flat, thereby causing the arc at a time of opening and closing on and after the next time. In the conventional case, in the case that the electric current of 25 kA is applied within the switch for about three second, the temperature of the electrode portion reaches 300 K, however, in accordance with the present embodiment, since the air gap is not generated in the conduction portion within the electrode, it is possible to hold down a temperature rise to 240 K, and it is possible to reduce a thermal loss at about 20%. Further, it is possible to prevent the electrode surface from being molten, and it is possible to reduce the generation of the art at a time of opening and closing.

Since the coupling plates 3 and 4 in the present embodiment are constructed by the member having the flexibility, for example, SUS or the like, a flexibility at a time of being fitted to the conductor rod 1 and the contact point electrode 2 is increased, and it becomes easy to fit at a time of coming into contact with the conductor rod 1 and the contact point electrode 2.

Further, in the present embodiment, the coupling plates 3 and 4 are divided into two sections, however, may be formed as one unit, or may be divided into three or more sections. At this time, if they are arranged uniformly in the diametrical direction, an incline or the like is not generated, and a stability for fixing is improved. Arranging uniformly in the diametrical direction indicates a case that a plurality of coupling plates are used and are arranged approximately symmetrically in a peripheral direction.

Second Embodiment

Figure 9:
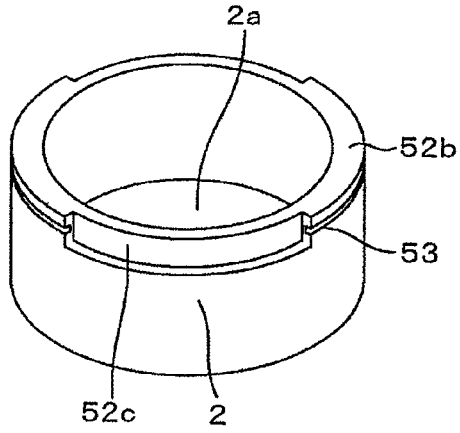
FIG. 9 is a view showing a contact point electrode in accordance with the second embodiment.
Figure 10:
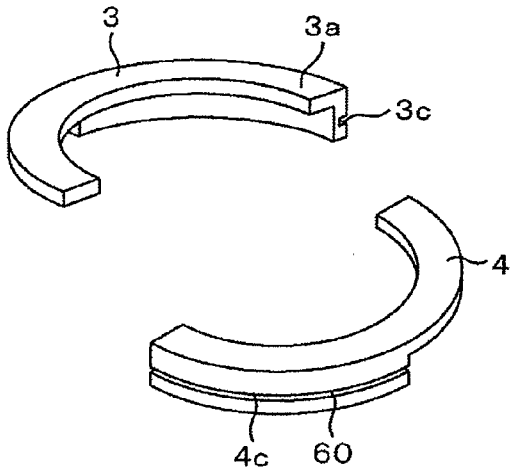
FIG. 10 is a view showing a coupling plate in accordance with the second embodiment.
Figure 11:
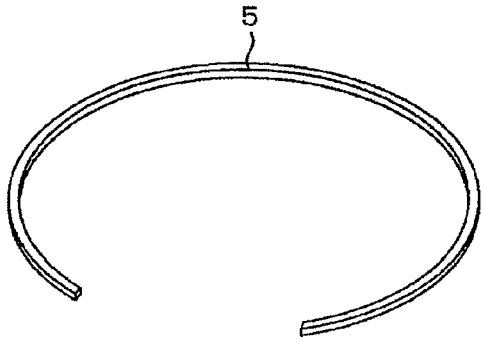
FIG. 11 is a view showing a ring pin in accordance with the second embodiment.

Next, a description will be given of a second embodiment in accordance with the present invention with reference to FIGS. 8 to 16. In the present embodiment, the contact electrode 2 is provided with concave portions (grooves) 52*c* at two positions in an upper end portion of the electrode, as shown in FIG. 9. A convex portion 52*b* having no concavity is provided on the same circumference as the concave portion 52*c*. A groove 53 is formed on an outer peripheral surface of the concave portion 52*b*. Further, as shown in FIG. 10, the coupling plates 3 and 4 in the present embodiment are provided with a fitting portion 4*c* in such a manner as to correspond to the concave portion 52*c* of the contact point electrode 2, and a portion fitted to the conductor rod 1 is structured in the same manner as the first embodiment. Further, in the fitting portion 4*c* provided in the coupling plates 3 and 4, there is formed a groove 60 constructing the same circumference as the groove 53 formed in the convex portion 52*b* of the contact point electrode 2 at a time of being fitted to the contact point electrode 2. Further, the contact point electrode 2 and the coupling plates 3 and 4 are fixed by fitting a ring pin 5 to the grooves 53 and the groove 60. In this case, the ring pin 5 is provided with a cut at an angle of circumference equal to or more than 5 degree from a center of the ring pin 5 in such a manner as to be fitted to the groove. The angle is set to be equal to or more than 5 degree because it is necessary to temporarily expand at a time of fitting the ring pin 5 to the contact point electrode and the coupling plate, and it becomes further easy to expand at that time if the angle is equal to or more than 5 degree. Of course, it does not mean that all angles less than 5 degree are excluded. In this case, the other portions than the portion mentioned above are the same as those of the first embodiment, and an overlapping description will be omitted.

Figure 12:
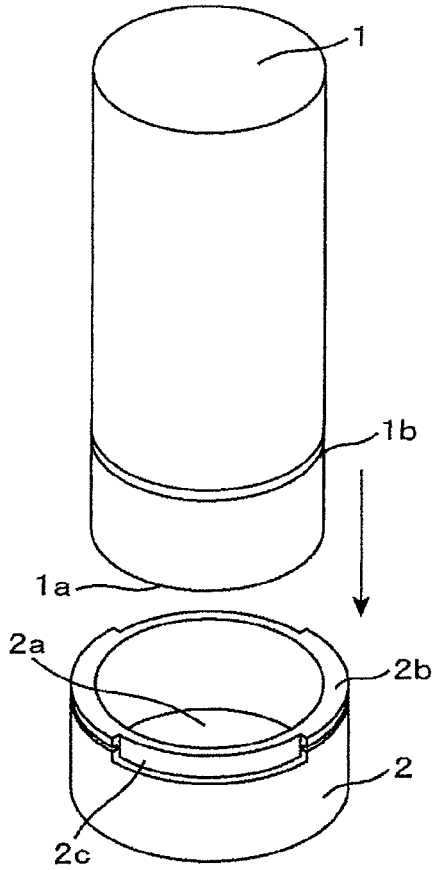
FIG. 12 is view showing a state in which a conductor rod is inserted to the contact point electrode in accordance with the second embodiment.
Figure 13:
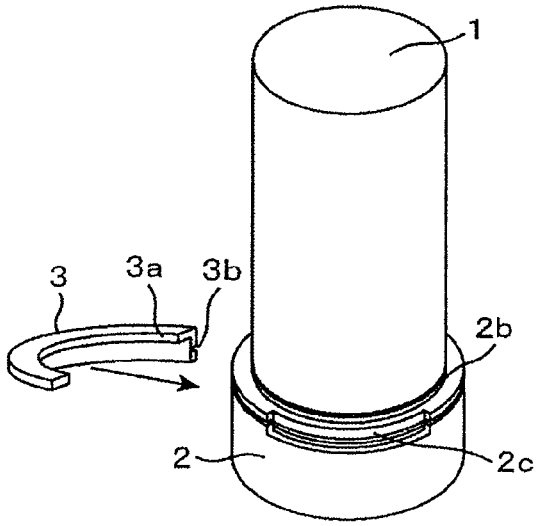
FIG. 13 is a view showing a state in which the coupling plate is fitted to the electrode portion in accordance with the second embodiment.
Figure 14:
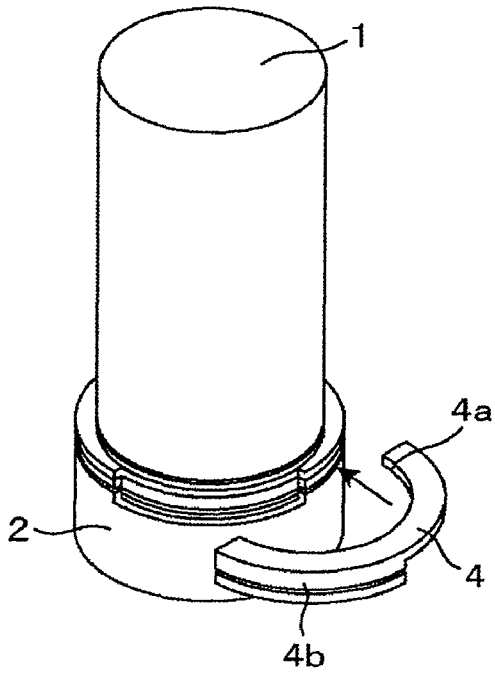
FIG. 14 is a view showing a state in which the coupling plate is fitted to the electrode portion in accordance with the second embodiment.
Figure 15:
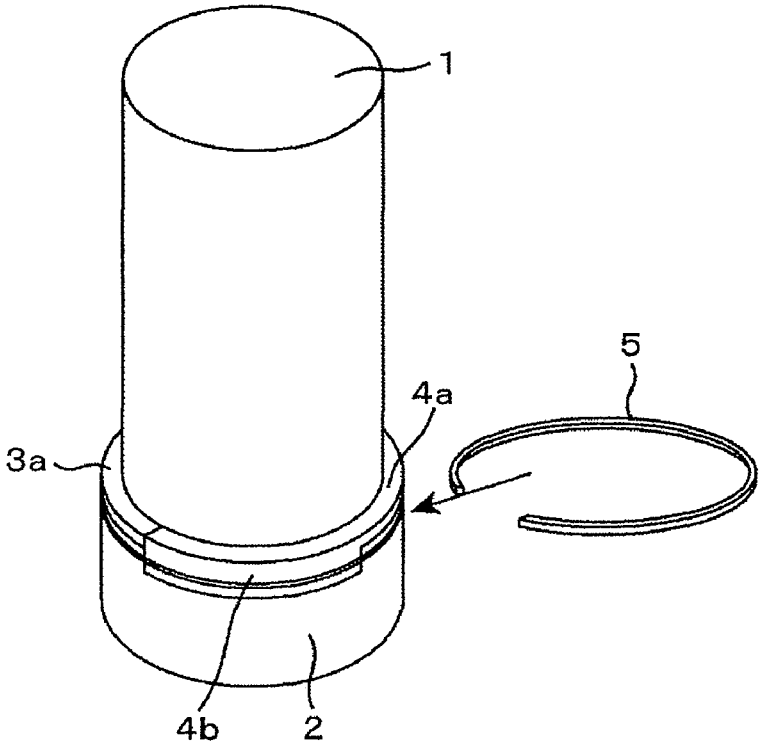
FIG. 15 is a view showing a state in which the ring pin is fitted to the electrode portion in accordance with the second embodiment.
Figure 16:
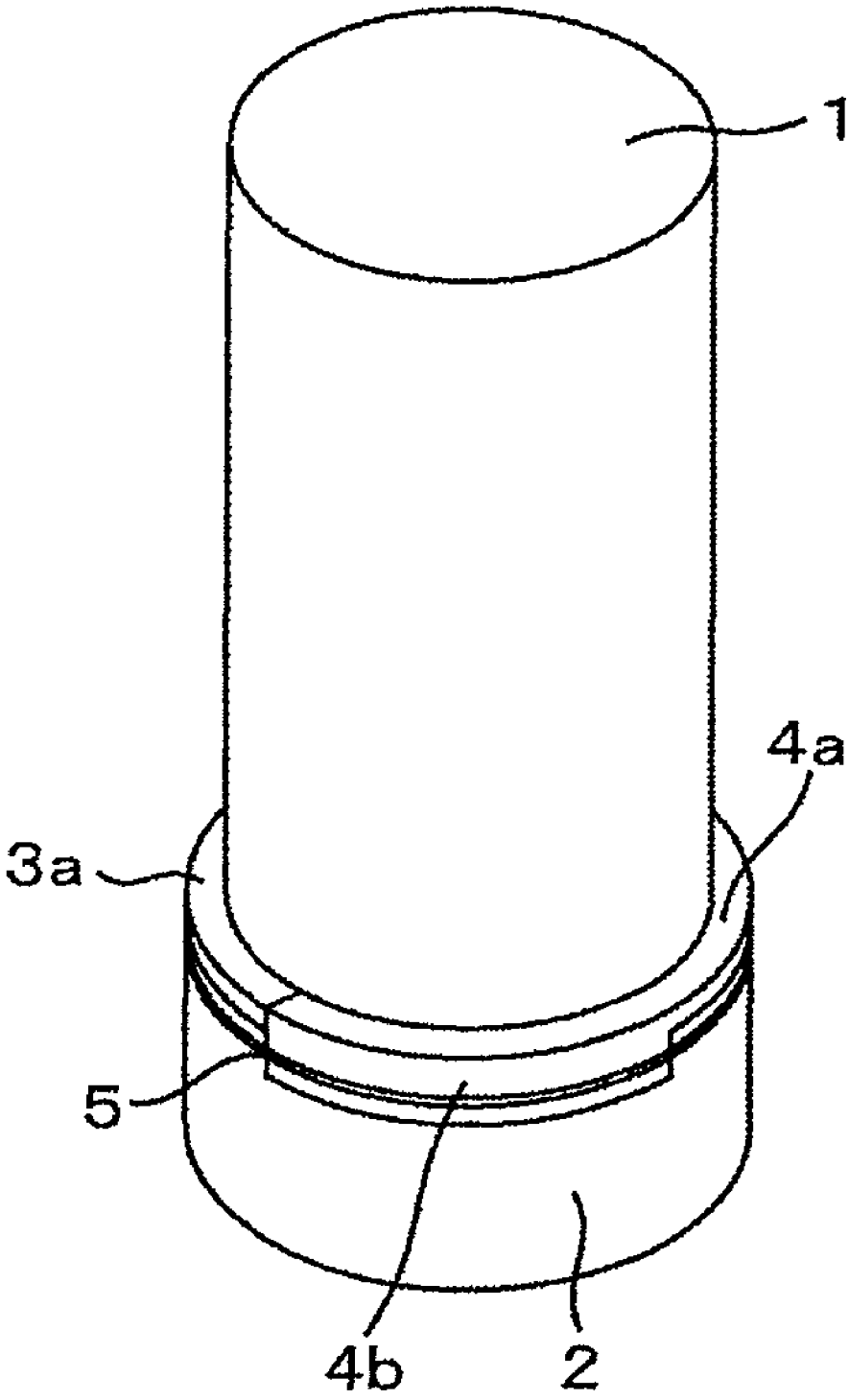
FIG. 16 is a completion drawing of the electrode portion in accordance with the second embodiment.

A description will be given of a different point from the first embodiment in a method of manufacturing the vacuum switch using the electrode mentioned above, with reference to FIGS. 12 to 16. The conductor rod 1 is inserted to the contact point electrode 2 as shown in FIG. 12, and the coupling plates 3 and 4 are fitted to the contact point electrode 2 as shown in FIGS. 13 and 14. Thereafter, the ring pin 5 is fitted to the groove 53 provided in the contact point electrode 2 and the groove 60 provided in the coupling plates 3 and 4. Accordingly, it is possible to fix the conductor rod 1 and the contact point electrode 2 in the first step.

The present embodiment can achieve the same effect as that of the first embodiment.

Further, in the present embodiment, the description is given of the structure using the ring pin 5 as the fixing member fixing the coupling plates 3 and 4 and the contact point electrode 2, however, it goes without saying that the fixing member is not limited to the ring pin, and can be replaced by a fixing member which can fix by fitting to a groove which is provided on the same circumference in the outer periphery of the coupling plate and the contact point electrode.

Further, the description is given of the ring pin 5 in the case that only one ring pin is provided, in the present embodiment, however, a structure in which it is separated into a plurality of pins is not excluded.

Further, in the present embodiment, the contact point electrode 2 is provide with the concave portions at two positions, however, may be provided at three positions or more. Further, there can be thought that two or more ring pins are used for fixing. In the case mentioned above, it goes without saying that it is necessary to increase the number of the grooves provided in the contact point electrode and the coupling plate in correspondence thereto.

Further, in order to improve the breaking performance of the electrode with respect to the contact point electrode 2 in both of the first and second embodiments mentioned above, there can be formed as a spiral electrode in which a hole 2*d* having a diameter equal to or less than an inner diameter of the contact point electrode is formed in the center portion close to the contact point shown in FIG. 1, and spiral grooves 2*e* are provided at two or more positions in the position except the portion lapping over a conductor outer diameter 1*c*' of the electrode center portion in the axial direction. The spiral groove 2*e* can be formed by forming a cut from a start point 2*e*' of the groove to an end point 2*e*" of the groove. In this case, in order to prevent the electrode from being separated by the spiral groove 2*e*, it is necessary to stop a position of the end point 2*e*" of the groove at a position of an outer periphery equal to or more than the diameter of the center portion contact point hole 2*d*. The air gap portion is not generated between the electrode and the conductor by applying the spiral electrode to the first and second embodiments, it is possible to prevent the warping of the electrode from the center of the spiral electrode to the end portion, by inserting the conductor to the vicinity of the contact point of the electrode, and a further effect can be achieved since a contact area of the contact point can be secured.

Further, not particularly referring in the first and second embodiments, however, the coupling plates 3 and 4 may be structured such as to fix to whichever position in the axial direction of the conductor rods.

Further, referring to the vacuum switch in each of the embodiments mentioned above, however, the vacuum switch includes a vacuum grounding switch aiming at grounding. In other words, it goes without saying that the first and second embodiments can be applied to the vacuum grounding switch.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An electrode for a switch comprising:

a conductor rod;

a contact point electrode inserted to said conductor rod; and a coupling plate fixing elements to an outer side in a diametrical direction of said conductor rod and said contact point electrode;

wherein said conductor rod is provided with a groove in a diametrical direction in an outer peripheral portion, wherein said contact point electrode is provided with a groove in a diametrical direction in an outer peripheral portion, and wherein said coupling plate is fitted to the groove in the diametrical direction which said conductor rod has its outer peripheral portion, and the groove in the diametrical direction which said contact point electrode has its outer peripheral portion, and fixes said conductor rod and said contact point electrode.

2. An electrode for a switch as claimed in claim 1, wherein said coupling plate is provided with a groove in a diametrical direction in an outer peripheral portion, wherein said contact point electrode is provided with a groove positioned in the same circumference as the groove which said coupling plate is provided in the diametrical direction in its outer peripheral portion, at a position except the outer peripheral portion to which said coupling plate is fitted, in the outer peripheral portion, and wherein said coupling plate is provided with a fixing member fitted to the groove in the diametrical direction which said coupling plate is provided in its outer peripheral portion, and the groove which said contact point electrode is provided in its outer peripheral portion, the groove being positioned in the same circumference as the groove which said coupling plate is provided in the diametrical direction in its outer peripheral portion.

3. An electrode for a switch as claimed in claim 2, wherein said coupling plate and/or said fixing member is constructed by a plurality of members.

4. An electrode for a switch comprising:

a conductor rod;

a contact point electrode inserted to said conductor rod; and a coupling plate fixing elements to an outer side in a diametrical direction of said conductor rod and said contact point electrode; and wherein said contact point electrode is provided with a spiral groove at a position except a portion lapping over said conductor rod, in an axial direction of said conductor rod.

5. A vacuum switch comprising:

a conductor rod having a groove in a diametrical direction in a part in an axial direction;

a contact point electrode provided with an insertion hole to which said conductor rod is inserted, structured such that said conductor rod is inserted to said insertion hole, and having a groove in a diametrical direction in an outer peripheral portion;

a coupling plate fitted to the groove in the diametrical direction which said conductor rod has, and the groove in the diametrical direction of the outer peripheral portion which said contact point electrode has, and fixing said conductor rod and said contact point electrode; and a vacuum vessel constructed by an insulation tube and a metallic end plate, connoting said conductor rod and said contact point electrode, and coming to vacuum in its inner portion, wherein a first brazing filler material is provided in a contact surface between said conductor rod and said contact point electrode, and wherein a second brazing filler material is provided between said insulation tube and said metallic end plate.

6. A vacuum switch comprising:

a conductor rod having a groove in a diametrical direction in a part in an axial direction;

a contact point electrode provided with an insertion hole of said conductor rod, structured such that said conductor rod is inserted to said insertion hole, provided with concave portions at two positions or more in an outer peripheral portion, and structured such that a portion except the concave portions in the outer peripheral portion has a groove in a diametrical direction;

a coupling plate fitted to the groove which said conductor rod has, and the concave portions which said contact point electrode has, and provided with a groove constructing the same circumference as the groove which said contact point electrode has in the portion except the concave portions in the outer peripheral portion, in the portion fitted to the concave portions which said contact point electrode has;

a ring pin fitted to the groove which said contact point electrode has in its outer peripheral portion and the groove which said coupling plate is provided, and fixing said contact point electrode and said coupling plate; and a vacuum vessel constructed by an insulation tube and a metallic end plate, connoting said conductor rod and said contact point electrode, and coming to vacuum in its inner portion, wherein a first brazing filler material is provided in a contact surface between said conductor rod and said contact point electrode, and wherein a second brazing filler material is provided between said insulation tube and said metallic end plate.

7. A vacuum switch as claimed in claim 5, wherein said coupling plate is provided with a flexibility.

8. A vacuum switch as claimed in claim 6, wherein said coupling plate is separated into two or more sections.

9. A vacuum switch as claimed in claim 5, wherein said contact point electrode is provided with spiral grooves at two positions or more in a portion except a portion lapping over said conductor rod, in an axial direction of said conductor rod.

10. A method of manufacturing an electrode for a switch, comprising a step of inserting a conductor rod to an electrode having an insertion hole, and thereafter fitting a coupling plate to an outer side in a diametrical direction of said conductor rod and said contact point electrode;

wherein a groove in a diametrical direction is formed in an outer peripheral portion in said coupling plate, and a groove positioned in the same circumferential shape as the groove which said coupling plate is provided in the diametrical direction in its outer peripheral portion, is formed at a position except the outer peripheral portion to which said coupling plate is fitted, in the outer peripheral portion, in said contact point electrode, and wherein the method has a step of fitting the coupling plate to an outer side in the diametrical direction of said conductor rod and said contact point electrode, and thereafter fitting a fixing member to the groove formed in said coupling plate and the groove formed in said contact point electrode, thereby fixing said coupling plate, said conductor rod and said contact point electrode.

11. A method of manufacturing a vacuum switch comprising a step of brazing an insulation tube and an end plate under a vacuum or a hydrogen gas, while connoting said electrode for the switch, after the step as claimed in claim 10.

12. A method of manufacturing a vacuum switch as claimed in claim 11, wherein the brazing step is constructed by only one brazing step under said vacuum or said hydrogen gas.

* * * * *